US006464456B2

(12) United States Patent
Darolia et al.

(10) Patent No.: US 6,464,456 B2
(45) Date of Patent: Oct. 15, 2002

(54) TURBINE VANE ASSEMBLY INCLUDING A LOW DUCTILITY VANE

(75) Inventors: Ramgopal Darolia, West Chester, OH (US); James Anthony Ketzer, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/801,118

(22) Filed: Mar. 7, 2001

(65) Prior Publication Data

US 2002/0127097 A1 Sep. 12, 2002

(51) Int. Cl.[7] ..... F01D 25/26
(52) U.S. Cl. ..... 415/134; 415/209.2; 415/191
(58) Field of Search ..... 475/134, 137, 475/191, 209.4, 210.1, 209.2, 208.2; 148/320, 420

(56) References Cited

U.S. PATENT DOCUMENTS 4,144,380 A * 3/1979 Beltran et al. ..... 428/679
4,300,868 A * 11/1981 Wilkinson et al. ..... 415/137
4,384,822 A * 5/1983 Schweikl et al. ..... 415/137
5,074,752 A * 12/1991 Murphy et al. ..... 415/209.4
5,328,327 A * 7/1994 Naudet ..... 415/160
5,411,370 A * 5/1995 Varsik ..... 415/209.4
5,626,462 A * 5/1997 Jackson et al. ..... 416/97 R
5,630,700 A * 5/1997 Olsen et al. ..... 415/134
5,640,767 A * 6/1997 Jackson et al. ..... 29/888.721
5,690,469 A * 11/1997 Deal et al. ..... 415/189
5,820,337 A * 10/1998 Jackson et al. ..... 415/200
5,833,773 A * 11/1998 Bewlay et al. ..... 148/422
6,110,555 A * 8/2000 Katz et al. ..... 428/44

* cited by examiner

*Primary Examiner*—Edward K. Look
*Assistant Examiner*—James M McAleenan
(74) *Attorney, Agent, or Firm*—Rodney M. Young; Lee H. Sachs

(57) ABSTRACT

At least one airfoil shaped vane made of a low ductility material, for example a ceramic base material such as a ceramic matrix composite or an intermetallic material such as NiAl material, is releasably carried in a turbine vane assembly including inner and outer vane supports by at least one high temperature resistant compliant seal. The seal isolates the vane from at least one of the vane supports and allows independent thermal expansion and contraction of the vane in respect to the support.

4 Claims, 5 Drawing Sheets

TURBINE VANE ASSEMBLY INCLUDING A LOW DUCTILITY VANE

The Government has rights to this invention pursuant to Contract No. N00019-91-C-0165 awarded by the Department of the Navy.

BACKGROUND OF THE INVENTION

This invention relates to turbine vane assemblies, for example of the type used in gas turbine engines. More particularly in one embodiment, it relates to a turbine vane assembly including at least one low ductility vane carried at least in part by a compliant seal to enable expansion and contraction of the vane independently from at least one of spaced apart metal supports or bands.

Components in sections of gas turbine engines operating at elevated temperatures in a strenuous, oxidizing type of gas flow environment typically are made of high temperature superalloys such as those based on at least one of Fe, Co, and Ni. In order to resist degradation of the metal alloy of such components, it has been common practice to provide such components with a combination of fluid or air cooling and surface environmental protection or coating, of various widely reported types and combinations.

One type of such a gas turbine engine component is a turbine stator vane assembly used as a turbine section nozzle downstream of a turbine engine combustion section. Generally, such assembly is made of a plurality of metal alloy segments each including a plurality of airfoil shaped hollow air cooled metal alloy vanes, for example two to four vanes, bonded, such as by welding or brazing, to spaced apart metal alloy inner and outer bands. The segments are assembled circumferentially into a stator nozzle assembly. One type of such gas turbine engine nozzle assembly is shown and described in U.S. Pat. No. 5,343,694—Toberg et al. (patented Sep. 6, 1994).

From evaluation of service operated turbine nozzles made of coated high temperature superalloys, it has been observed that the strenuous, high temperature, erosive and corrosive conditions existing in the engine flow path downstream of a gas turbine engine combustion section can result in degradation of the environmental resistant coating and/or alloy substrate structure of vanes of the nozzle. Repair or replacement of one or more of the vanes has been required prior to returning such a component to service operation. Provision of turbine vanes of adequate strength and more resistant to such degradation would extend component life and time between necessary repairs, decreasing cost of operation of such an engine.

BRIEF SUMMARY OF THE INVENTION

In one form, the present invention provides a turbine vane assembly comprising an outer vane support, an inner vane support in a fixed spaced apart position from the outer vane support, and at least one airfoil shaped vane supported between the outer and inner vane supports. The vane is of a low ductility material, for example based on a ceramic matrix composite or an intermetallic material, having a room temperature ductility no greater than about 1%. The outer and inner vane supports are of material having a room temperature ductility of at least about 5%. A high temperature resistant compliant seal is disposed between the vane and at least one of the vane supports, substantially sealing the vane from passage of fluid between the vane and the vane support, enabling the vane to expand and contract independently of the vane support. In one form, the vane supports are of a high temperature metal alloy, for example based on at least one of Fe, Co, and Ni, having a room temperature tensile ductility in the range of about 5–15%.

DETAILED DESCRIPTION OF THE INVENTION

Figure 1:
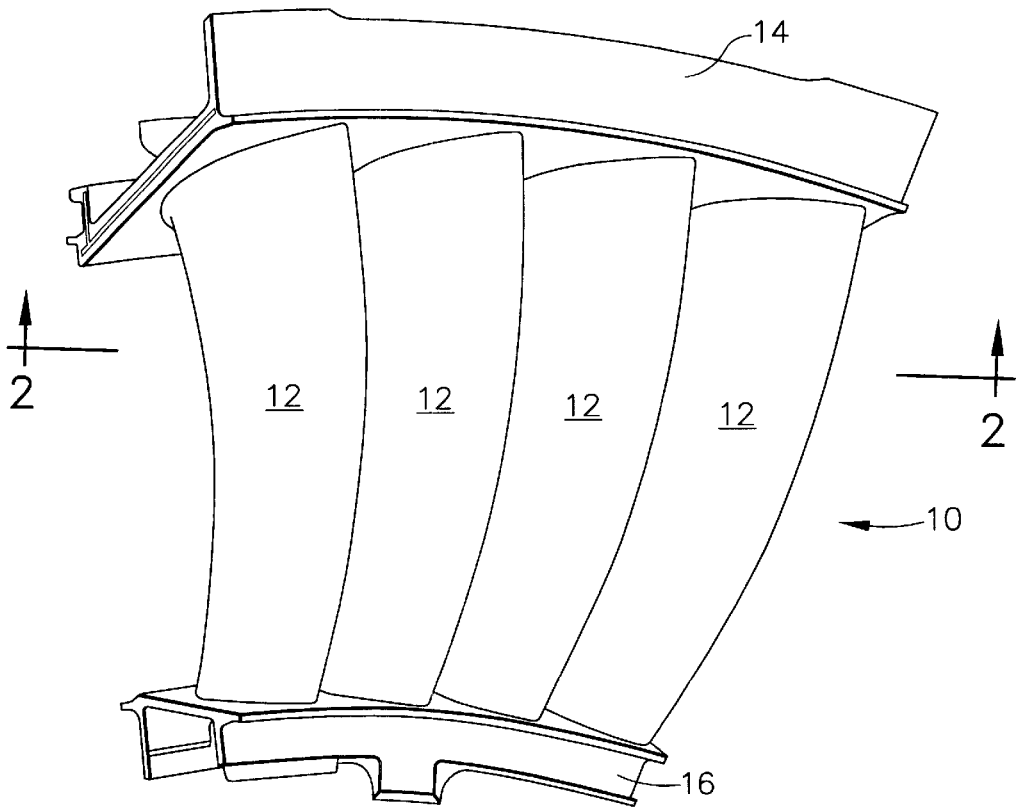
FIG. 1 is a perspective view of a typical gas turbine engine nozzle vane segment.

Certain ceramic base and intermetallic type of high temperature resistant materials, including monolithic as well as intermetallic base and ceramic based composites, have been developed with adequate strength properties along with improved environmental resistance to enable them to be attractive for use in the strenuous type of environment existing in hot sections of a turbine engine. However, such materials have the common property of being very low in tensile ductility compared with high temperature metal alloys generally used for their support structures. In addition, there generally is a significant difference in coefficients of thermal expansion (CTE) between such materials and alloys, for example between low ductility ceramic matrix composites (CMC) or intermetallic materials based on NiAl, and typical commercial Ni base and Co base superalloys currently used as supports in such engine sections.

If such low ductility materials are rigidly supported by such high temperature alloy structures, thermal strains can be generated in the low ductility material from the mismatch of properties in an amount that can result in fracture of the low ductility material. For example, a typical Ni base superalloy such as commercially available Rene' N5 alloy, forms of which are described in U.S. Pat. No. 5,173,255—Ross et al., and used in gas turbine engine turbine components, has a room temperature tensile ductility in the range of about 5–15% (with a CTE in the range of about 7–10 microinch/inch/°F.). The low ductility materials have a room temperature tensile ductility of no greater than about 1% (with a CTE in the range of about 1.5–8.5 microinch/inch/°F.). For example, a typical commercially available low ductility ceramic matrix composite (CMC) material such as SiC fiber/SiC matrix CMC has a room temperature tensile ductility in the range of about 0.4–0.7%, and a CTE in the range of about 1.5–5 microinch/inch/°F. Similarly, a low ductility NiAl type intermetallic material has near zero tensile ductility, in the range of about 0.1–1%, with a CTE of about 8–10 microinch/inch/°F. Therefore, according to the present invention, a low ductility material is defined as one having a room tensile ductility of no greater than about 1%.

In addition to such significant differences in room temperature ductility, comparison of CTE's between the low ductility material and one or more high temperature alloy support materials, for example superalloys based on at least one of Fe, Co, and Ni, shows that the ratio of the average of the CTE's of the more ductile support alloys to the CTE of the low ductility material is at least about 0.8. Typical examples of such ratios for a Ni base superalloy to CMC low ductility material are in the range of about 1.4–6.7 and to NiAl low ductility material are in the range of about 0.8–1.2.

Thus there is a significant difference or mismatch in such properties between a low ductility material and such an alloy support. Rigid, fixed assembly of such materials such as a low ductility vane between high temperature alloy supports in a turbine vane assembly can enable generation in the vane of a thermal strain sufficient to result in fracture or crack initiation in the vane during engine operation. Therefore, it is desirable to avoid crack initiation in a low ductility material.

Ductility represents plastic elongation or deformation required to prevent initiation of cracks, for example for brittle materials under local or point loading. However another mechanical property, fracture toughness, represents the ability of the material to minimize or resist propagation in the presence of an existing crack or defect. In one form, the low ductility material is defined as having a fracture toughness of less than about 20 ksi·inch$^{1/2}$ in which "ksi" is thousands of pounds per square inch. Typically, the CMC materials have a fracture toughness in the range of about 5–20 ksi·inch$^{1/2}$; and the NiAl intermetallic materials have a fracture toughness in the range of about 5–10 ksi·inch$^{1/2}$.

A form of the present invention provides a combination of members and materials that compliantly and releasably captures a low ductility member such as a CMC or intermetallic base turbine vane within a supporting structure such as a superalloy band, avoiding generation of excessive thermal strain in the low ductility material. In that form of the combination, a compliant seal is disposed between and in contact both with at least one end of the low ductility vane and a support in juxtaposition with the end. Concurrently the compliant seal prevents flow of fluid such as air and/or products of combustion between the vane end and the support while isolating the low ductility vane from the support and enabling each to expand and contract from thermal exposure independent of one another.

Forms of the compliant seal used in the present invention sometimes are referred to as rope seals. Typical rope seal stress-strain curves comparing deflection of the seal at different loads confirm the compliance and resilience of such a seal. In forms for use at elevated temperatures, rope seals include woven or braided ceramic fibers or filaments, forms of which are commercially available as Nextel alumina material and as Zircar alumina silica material. Some forms of the compliant seals, for example for strength and/or resistance to surface abrasion, include one or more of the combination of a metallic core, such as a wire of commercial Hastelloy X alloy, within the ceramic filaments and/or an outer sheath of thin, ductile metal about the ceramic filaments. The woven or braided structure of the ceramic fibers or filaments provide compliance and resilience.

The present invention will be more fully understood by reference to the drawings. FIG. 1 is a perspective view of a gas turbine engine turbine stator vane segment or assembly shown generally at 10 including four airfoil shaped vanes 12 disposed between an outer vane support or band 14 and a fixed position spaced apart inner vane support or band 16. In a typical current commercial gas turbine engine, the vanes and vane supports each are made of a high temperature alloy and bonded together, as shown, by welding and/or brazing. This secures the vanes with the bands in a fixed relative position and prevents leakage of the engine flow stream from the flow path through the bands. A plurality of matching vane segments is assembled circumferentially into a turbine nozzle, for example as shown in the above-identified Toberg et al. patent.

Figure 2:
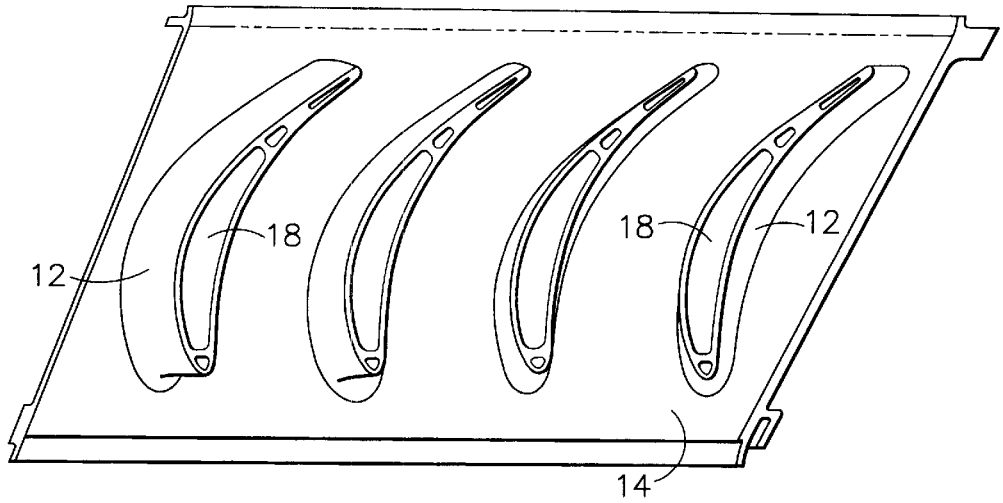
FIG. 2 is a sectional view of the vane segment of FIG. 1 along lines 2—2 of FIG. 1.
Figure 6:
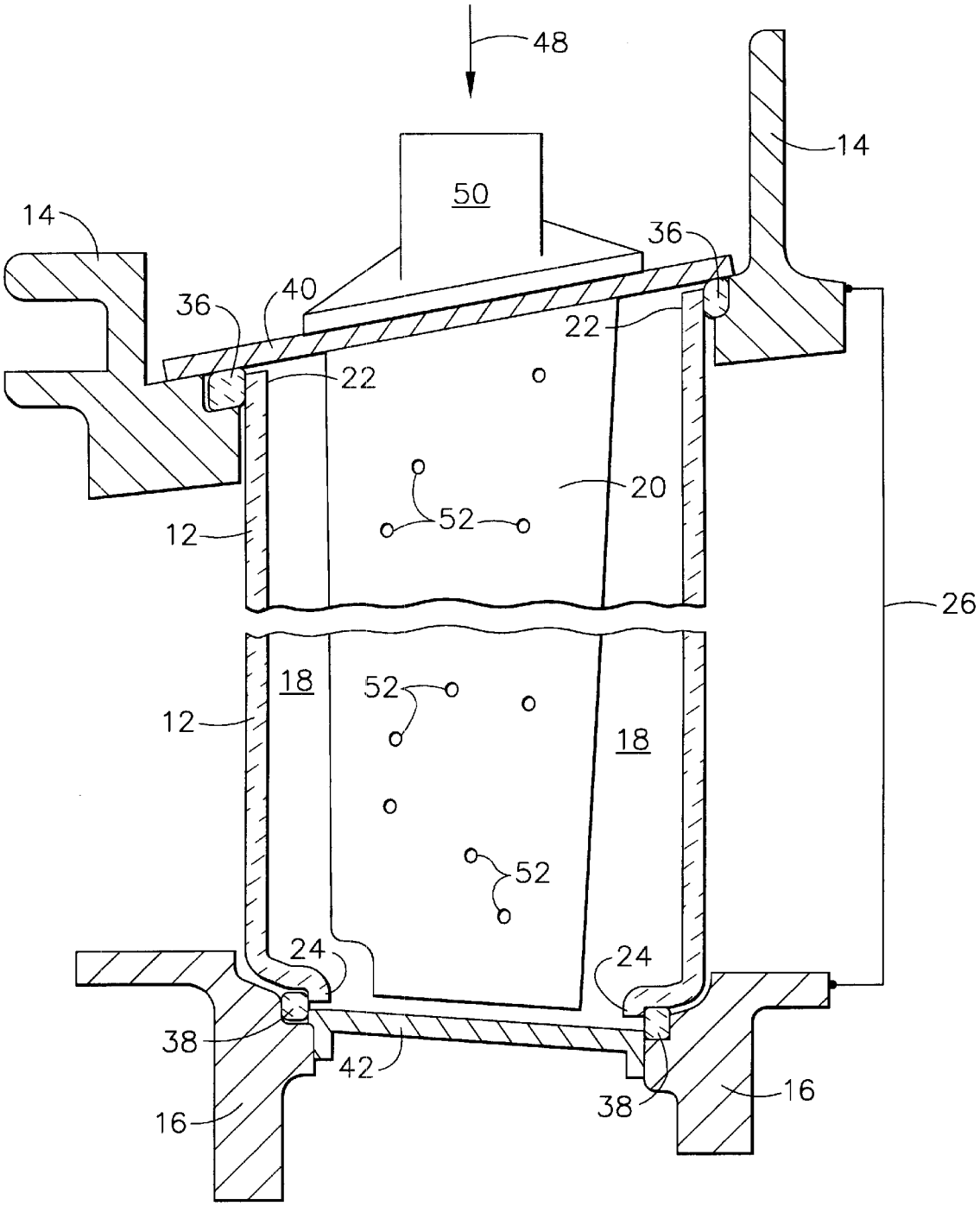
FIG. 6 is a view as in FIG. 3 with a cooling air insert disposed within the vane hollow interior.

To enable air cooling of each segment 10, vanes 12, as shown in the sectional view of FIG. 2 along lines 2—2 of FIG. 1, include a hollow interior 18 to receive and distribute cooling air through and from the vane interior. In some embodiments, a vane insert 20, shown in FIG. 6, is disposed in vane hollow interior 18 to distribute cooling air within and through vane 12 and through cooling air discharge openings (not shown), generally included through the vane wall.

Figure 3:
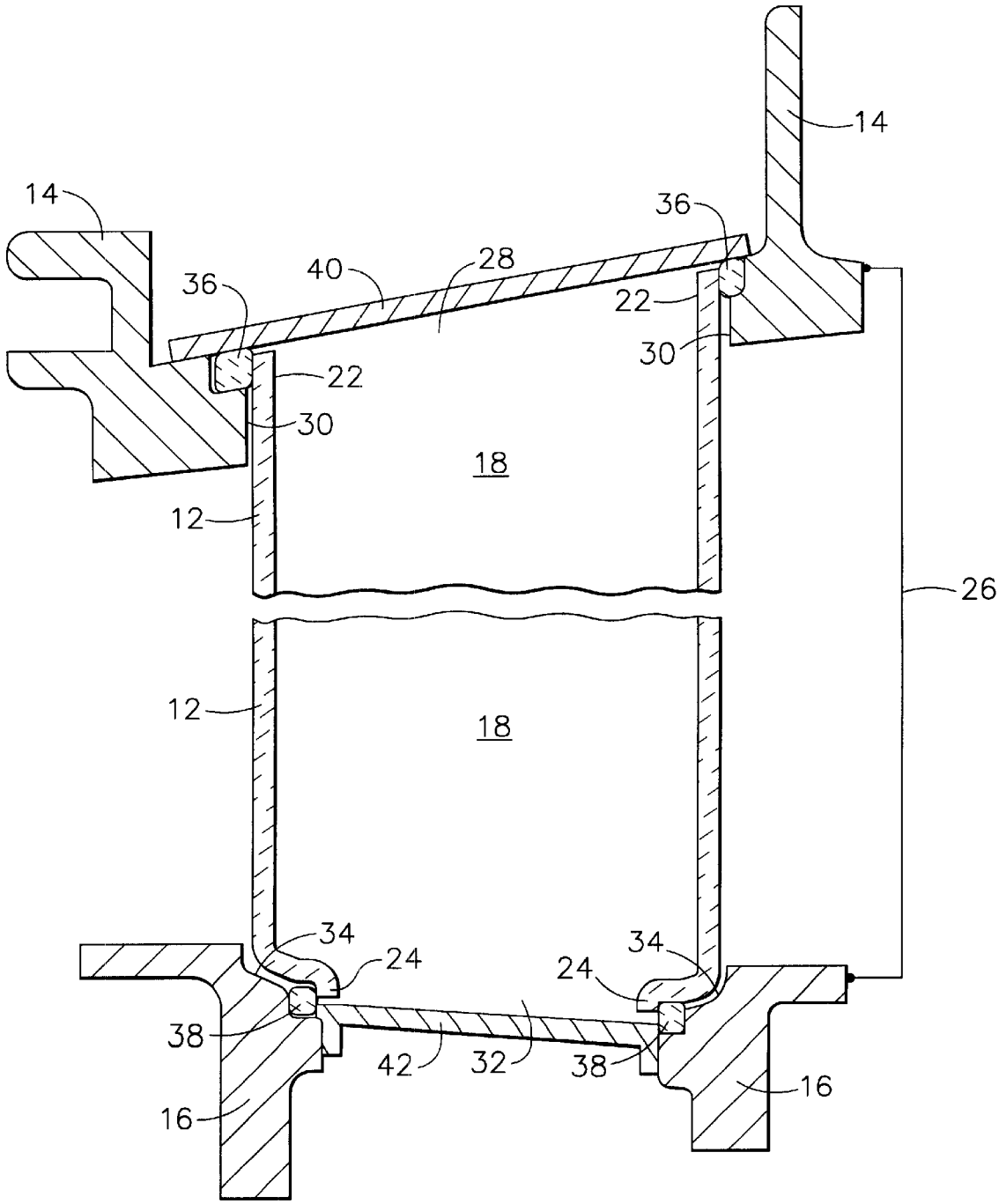
FIG. 3 is a diagrammatic, fragmentary sectional view of one embodiment of the present invention showing a low ductility vane carried by compliant seals between outer and inner metal alloy vane supports.

One embodiment of the present invention is shown in the diagrammatic, fragmentary sectional view of FIG. 3. Vane 12 is made of a low ductility material of the type described above, in the drawings represented as a ceramic material. Vane 12 includes a vane radially outer end 22 and a vane radially inner end 24. Metal alloy outer vane support 14 includes therein an opening 28 defined by outer opening wall 30 sized generally to receive outer end 22 of vane 12. Metal alloy inner vane support 16 includes therein an opening 32 defined by inner opening wall 34 sized generally to receive inner end 24 of vane 12. Outer vane support 14 and inner vane support 16 are held in a fixed spaced apart position in respect to one another. If all of the vanes 12 are of a low ductility material not rigidly held between outer and inner vane supports 14 and 16, the vane supports are held in such fixed spaced apart relationship by a positioning means, represented diagrammatically at 26. For example such a positioning means can include at least one of a rigid metal bolt, tube, rod, strut, etc.

Disposed between and in contact with both vane outer end 22 and outer opening wall 30 is first compliant seal 36. Seal 36 carries vane outer end 22 within opening 28 independently from outer opening wall 30 to enable independent relative movement between vane 12 and outer support 14. For example such relative movement can result from different expansion and contraction rates between juxtaposed materials during engine operation. Concurrently, seal 36 substantially seals vane end 22 from passage thereabout of fluid from the engine flow stream.

In the embodiment of FIG. 3, disposed between and in contact with both vane inner end 24 and inner opening wall 34 is a second compliant seal 38. Seal 38 carries vane inner end 24 within opening 32 independently from inner opening wall 34 to enable independent relative movement between vane 12 and inner support 16. Concurrently, seal 38 substantially seals vane end 24 from passage thereabout of fluid from the engine flow stream.

Such disposition of the compliant seal or seals in FIG. 3 captures vane 12 between outer band 14 and inner band 16 while enabling independent thermal expansion and contraction of the vane and the supports. The compliance of the seals avoids application of compressive stress to vane 12, avoiding stress fracture of the vane. Included in the embodiment of FIG. 3 is an outer seal retainer 40, securely bonded with outer support 14, for example by welding or brazing.

Seal retainer 40 holds seal 36 in position between vane outer end 22 and outer support opening wall 30. Also included in that embodiment is an inner seal retainer 42, similarly bonded with inner support 16, to hold seal 38 in position between vane inner end 24 and inner support opening wall 34.

Figure 4:
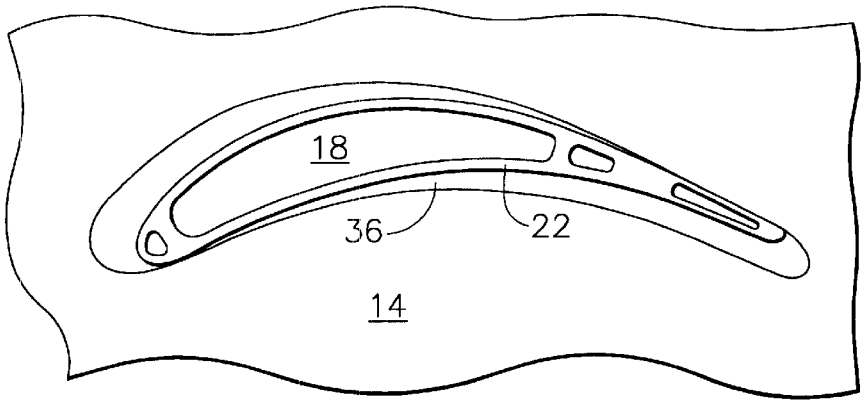
FIG. 4 is diagrammatic top view of the vane of FIG. 3 before an outer seal retainer has been applied.

FIG. 4 is a diagrammatic fragmentary top view of a portion of FIG. 3 before bonding of outer seal retainer 40 to outer support 14. FIG. 4 shows the general airfoil shape of vane outer end 22 and the position or disposition of compliant seal 36 about the vane end.

Figure 5:
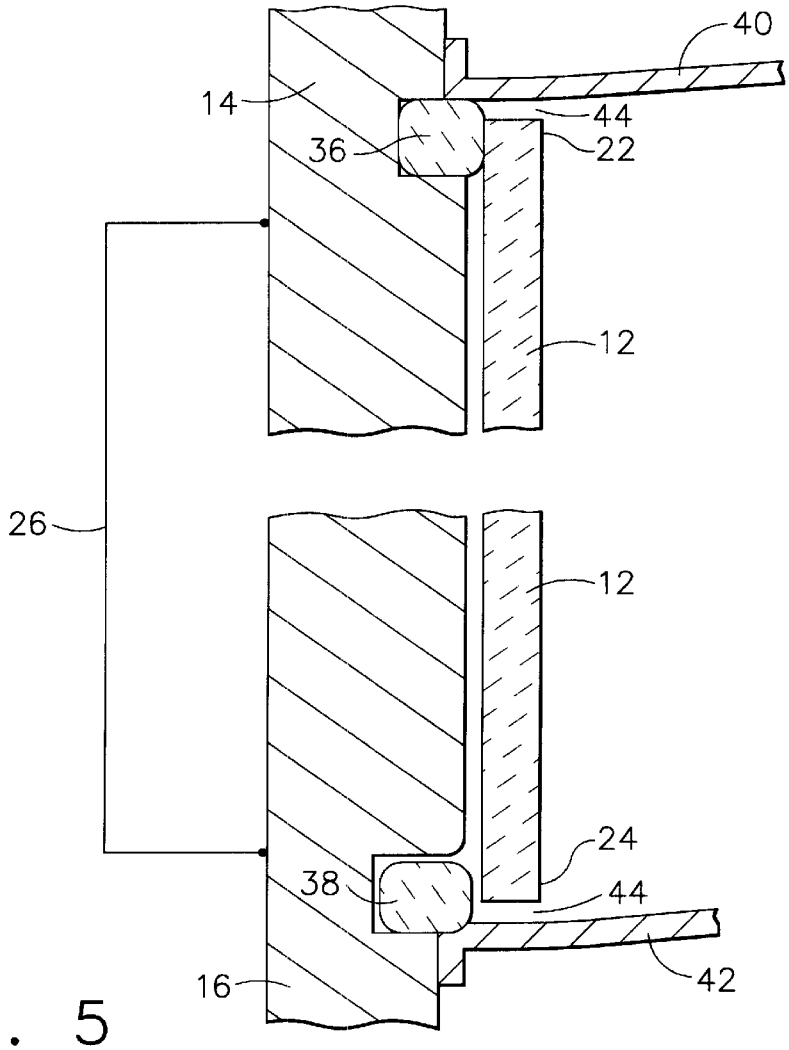
FIG. 5 is a diagrammatic, fragmentary sectional view of another embodiment of the present invention.

FIG. 5 is a diagrammatic, enlarged fragmentary sectional view of another embodiment of the present invention including the same general members as in FIG. 3. FIG. 5 shows more clearly a space 44 between at least one end of vane 12 and a seal retainer to enable independent expansion and contraction of vane 12 in respect to the metal supporting structure.

FIG. 6 is a diagrammatic, fragmentary view as in FIG. 3, partially sectional to show insert 20 disposed in vane hollow interior 18. Insert 20 provides air for cooling to and through hollow interior 18 of vane 12. For example, cooling air, represented by arrow 48 is provided through cup-like structure 50 to insert 20 within vane 12. Cooling air is distributed by insert 20 within hollow interior 18 through a plurality of insert openings, some of which are shown at 52. Typically, cooling air is discharged from vane hollow interior 18 through cooling air openings (not shown) through walls of vane 12 and/or through openings (not shown) through at least one seal retainer, in a manner well known and widely used in the gas turbine engine art. In the embodiment of FIG. 6, insert 16 first is bonded with outer seal retainer 40 through an appropriately shaped opening in retainer 40 to provide a combination seal retainer and cooling air insert for assembly and bonding as a unit to outer support 14.

Figure 7:
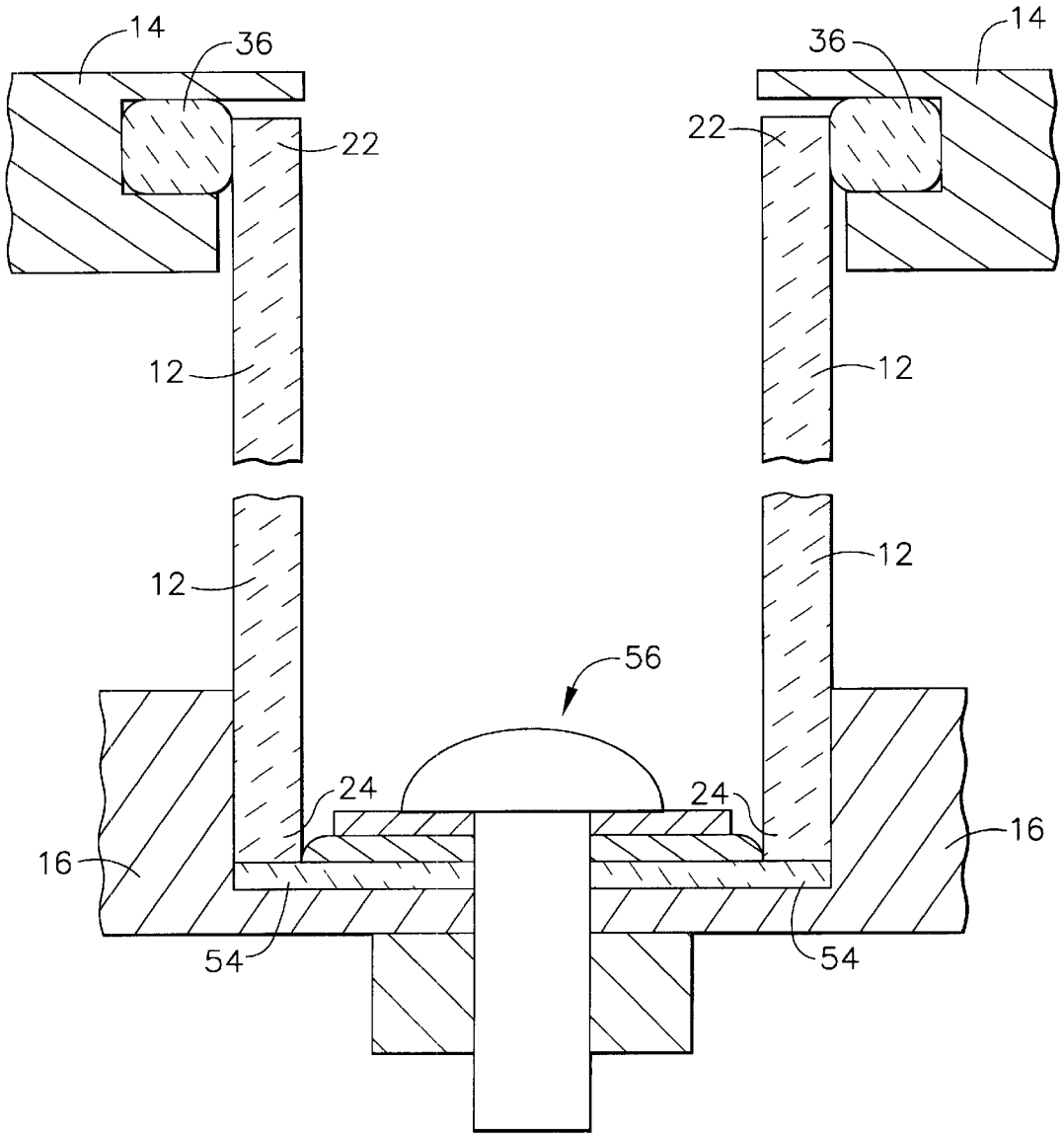
FIG. 7 is a diagrammatic, fragmentary, partially sectional view of another embodiment of the present invention showing a low ductility vane carried at its radially inner end by a fixed arrangement and releasably carried at its radially outer end by a compliant seal between its outer end and an outer metal alloy vane support.

FIG. 7 is a diagrammatic, fragmentary, partially sectional view of another embodiment of the present invention. In that form, vane 12, for example of an NiAl low ductility intermetallic material, is secured at its radially inner end 24 by the combination of an NiAl vane end cap 54 and a metal pin, washer and pad assembly shown generally at 56. However, outer end 22 of vane 12 is releasably and compliantly held, as described above, by compliant seal 36 to enable vane 12 to expand and contract independently of outer support 14.

The present invention has been described in connection with specific examples and combinations of materials and structures. However, it should be understood that they are intended to be typical of rather than in any way limiting on the scope of the invention. Those skilled in the various arts involved, for example technology relating to gas turbine engines, to metallurgy, to non-metallic materials, to ceramics and reinforced ceramic structures, etc., will understand that the invention is capable of variations and modifications without departing from the scope of the appended claims.

What is claimed is:

1. A turbine vane assembly comprising:

an outer vane support;

an inner vane support in a fixed spaced apart position from the outer vane support; and, at least one airfoil shaped vane supported between the outer and inner vane supports;

the vane being of a low ductility material having a room temperature tensile ductility no greater than about 1% and selected from the group consisting of ceramic base materials and intermetallic materials;

the outer and inner vane supports being of material having a room temperature tensile ductility of at least about 5%; and, a high temperature resistant compliant seal disposed between the vane and at least one of the outer and inner vane supports, substantially sealing the vane from passage of fluid between the vane and the vane support, the compliant seal isolating the vane from the vane support, enabling the vane to expand and contract independently of the vane support;

the at least one airfoil shaped vane including a vane radially outer end and a vane radially inner end;

the outer vane support including therein at least one outer support opening defined by an outer support opening wall sized generally to receive the vane outer end, the outer vane support made of a material having a first coefficient of thermal expansion (CTE);

the inner vane support including therein at least one inner support opening defined by an inner support opening wall generally sized to receive the vane inner end, the inner vane support made of a material having a second CTE;

the vane low ductility material having a third CTE different from the first CTE and second CTE, the ratio of the average of the first CTE and the second CTE to the third CTE being at least about 0.8;

at least one of the vane outer end and the vane inner end being releasably disposed in the respective support opening in juxtaposition with the respective support opening wall;

the high temperature resistant compliant seal being disposed between the at least one vane end and the respective support opening wall, substantially sealing the vane end from passage of fluid thereabout;

wherein, in combination:

when the selected low ductility material is a ceramic base material comprising a ceramic matrix composite with a fracture toughness of less than about 20 ksi·inch$^{1/2}$ and a room temperature tensile ductility in the range of about 0.4–0.7%, the ratio is in the range of about 1.4–6.7; and, when the selected low ductility material is an intermetallic material comprising a NiAl intermetallic material with a fracture toughness of less than about 20 ksi·inch$^{1/2}$, and a room temperature tensile ductility in the range of about 0.1–1%, the third CTE is in the range of about 8–10 microinch/inch/°F.; the fracture toughness is in the range of about 5–10 ksi·inch$^{1/2}$; and the ratio is in the range of about 0.8–1.2.

2. The assembly of claim 1 in which the outer vane support and the inner vane support are high temperature metal alloys based on at least one element selected from the group consisting of Fe, Co, and Ni, and having a CTE of at least about 7 microinch/inch/°F.

3. The assembly of claim 1 in which the low ductility material is a ceramic base material comprising a SiC fiber/SiC matrix ceramic matrix composite material having a room temperature tensile ductility in the range of about 0.4–0.7%, a third CTE in the range of about 1.5–5 microinch/inch/°F., and a fracture toughness in the range of about 5–20 ksi·inch$^{1/2}$.

4. The assembly of claim 1 in which the low ductility material is an intermetallic material comprising a NiAl intermetallic material having a room temperature tensile ductility in the range of about 0.1–1%, a third CTE in the range of about 8–10 microinch/inch/°F., and a fracture toughness in the range of about 5–10 ksi·inch$^{1/2}$.

* * * * *